US006860744B2

(12) United States Patent
Maruyama et al.

(10) Patent No.: US 6,860,744 B2
(45) Date of Patent: Mar. 1, 2005

(54) LOW-PROFILE CONNECTOR

(75) Inventors: Shinichiro Maruyama, Yamato (JP); Masami Sasao, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/483,693

(22) PCT Filed: Jul. 18, 2002

(86) PCT No.: PCT/US02/22885

§ 371 (c)(1),
(2), (4) Date: Jan. 13, 2004

(87) PCT Pub. No.: WO03/009426

PCT Pub. Date: Jan. 30, 2003

(65) Prior Publication Data

US 2004/0175969 A1 Sep. 9, 2004

(30) Foreign Application Priority Data

Jul. 19, 2001 (JP) ..... 2001/219121

(51) Int. Cl.[7] ..... H01R 12/00
(52) U.S. Cl. ..... 439/79

(58) Field of Search ..... 439/79, 83, 541.5

(56) References Cited

U.S. PATENT DOCUMENTS

| | | | | | |
|---|---|---|---|---|---|
| 4,687,267 | A | * | 8/1987 | Header et al. | 439/62 |
| 5,584,709 | A | * | 12/1996 | Kiat | 439/79 |
| 5,975,918 | A | * | 11/1999 | Quillet et al. | 439/79 |
| 6,065,978 | A | * | 5/2000 | Dehan et al. | 439/79 |
| 6,155,843 | A | * | 12/2000 | Tung | 439/64 |
| 6,358,067 | B1 | * | 3/2002 | Takase et al. | 439/79 |
| 2001/0008811 | A1 | * | 7/2001 | Soga et al. | 439/79 |

* cited by examiner

*Primary Examiner*—Tho D. Ta
(74) *Attorney, Agent, or Firm*—Robert J. Zeitler

(57) ABSTRACT

Disclosed is an improvement in a right-angled type of connector having a plurality of terminals parallel-arranged in its insulating housing, each terminal comprising a tail and a contact section integrally connected to the tail at right angles, the tail being to be inserted in a selected through-hole in an associated printed circuit board. The terminal has an intermediate crank-like section formed between its tail and contact section, thereby lowering the contact section toward the tip end of the tail. This allows the connector housing to be reduced in height.

6 Claims, 6 Drawing Sheets

PRIOR ART

PRIOR ART

LOW-PROFILE CONNECTOR

FIELD OF THE INVENTION

The present invention relates to a connector for use in making an electrical connection between electrical wires and a printed circuit board, or between two printed circuit boards.

BACKGROUND OF THE INVENTION

Conventional right-angle connectors are shown, for example, in Japan Utility Model Application Laid-Open No. 64-46976 and Patent Application Laid-Open Nos. 5-290927 and 7-192815. It has a plurality of terminals parallel-arranged in its insulating housing. Each terminal comprises a tail and a contact section integrally connected to the tail at right angles. The tails of the terminals are inserted in through-holes made in an associated printed circuit board whereas the contact sections of the terminals are engaged with the contacts of its mating connector.

FIGS. 7 and 8 shows one example of such right-angled type of electrical connector. As shown, it has terminals 102 parallel-arranged, as viewed in the direction perpendicular to the plane of the drawing sheet, in its insulating housing 101. Each terminal 102 comprises a tail 104 and a contact section 103 integrally connected to the tail 104 at right angles. Thus, it has a bent section 105 formed at the horizontal-to-vertical transiency. The contact section 103 is contiguous to a linear press-fitting section 106, which is elongated as far as the bent section 105, and is engaged partly with the insulating housing 101.

As seen from the drawing, all tails 104 are inserted loosely in the convergent holes of a movable guide plate 107, thereby allowing the guide plate 107 to move close or apart from the insulating housing. When the guide plate is put close to the insulating housing, it will protect the tails 104 from being bent. As seen from FIG. 8, the guide plate 107 is raised and applied to the insulating housing, and then, the tails 104 of the terminals 102 are inserted in the through-holes 109 of the printed circuit board 108 to be soldered there.

As seen from FIG. 8, the right-angled type of connector is relatively tall, and is higher than the other electric and electronics parts which are mounted on the printed circuit board. The height "H" of the electrical connector, therefore, prevents the reducing of the profile of an electric device having such right-angled type of connector mounted on its printed circuit board.

SUMMARY OF THE INVENTION

One object of the present invention is to provide a low-profiled, right-angled type of connector whose height is comparable to other electric or electronic parts to be mounted on a printed circuit board.

To attain this object each terminal has an intermediate crank-like section formed between its tail and contact section, thereby lowering the contact section toward the tip end of the tail.

The terminals may be arranged in upper and lower lines, each terminal comprising an engagement section integrally connected to the contact section on one end and to the intermediate crank-like section on the other end, which crank-like section ending with the tail, the upper straight extension of the crank-like section of each of the terminals arranged in the lower line lying at a level higher than the level at which the engagement section of each of the terminals arranged in the higher line.

The insulating housing may have stop surfaces to prevent the upper straight extensions of the intermediate crank-like sections of the upper and lower terminals from rising up when the connector is mounted to its mounting substrate.

The insulating housing may have a movable guide plate attached to its main body by allowing the tails to pass through the through-holes made in the movable guide plate, and the movable guide plate being so sized and shaped to sandwich the upper straight extensions of the intermediate crank-like sections of the upper and lower terminals between the stop surfaces and the guide plate when the tails are inserted in the through-holes of the associated printed circuit board.

The insulating housing may have L-shaped metal pegs on the opposite ends of the parallel-alignment of the terminals, extending almost the full lateral length from the contact sections of the terminals to the tails of the terminals with their depending sections descending down as far as the tip ends of the tails.

Other objects, features and advantages of the invention will be apparent from the following detailed description taken in connection with the accompanying drawings.

BRIEF DESCRIPTION OF THE ACCOMPANYING DRAWINGS

The organization and manner of the structure and operation of the invention, together with further objects and advantages thereof, may best be understood by reference to the following description, taken in connection with the accompanying drawings, wherein like reference numerals identify like elements in which.

DESCRIPTION OF THE PREFERRED EMBODIMENTS

Figure 1:
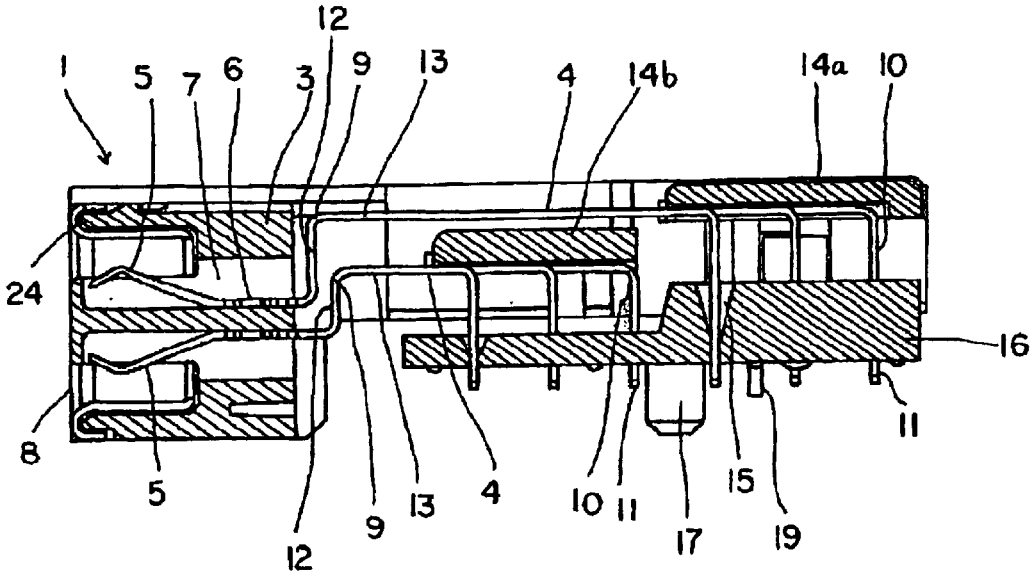
FIG. 1 is a cross section of a low-profiled, right-angled type of connector according to the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
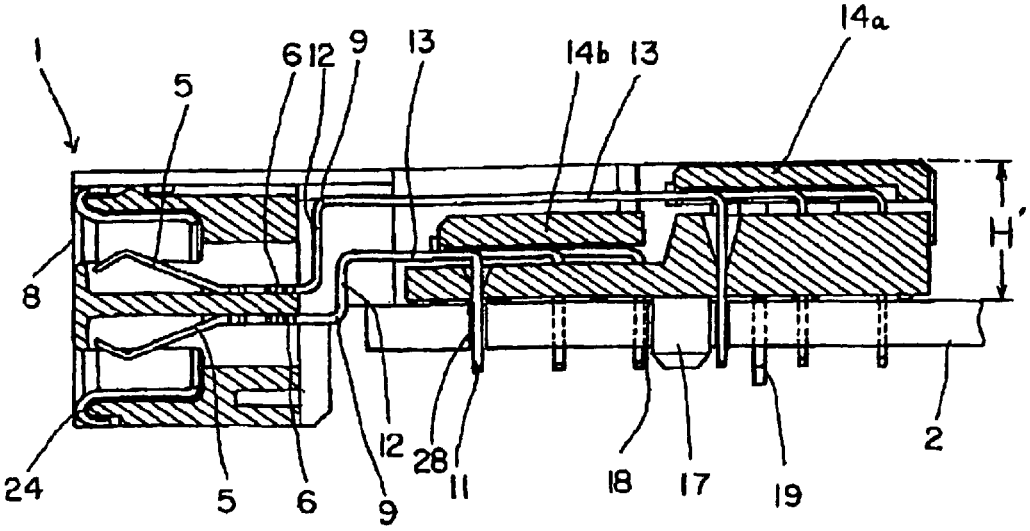
FIG. 2 is similar to FIG. 1, but showing the low-profiled, right-angled type of connector as being mounted on a printed circuit board.
Figure 4:
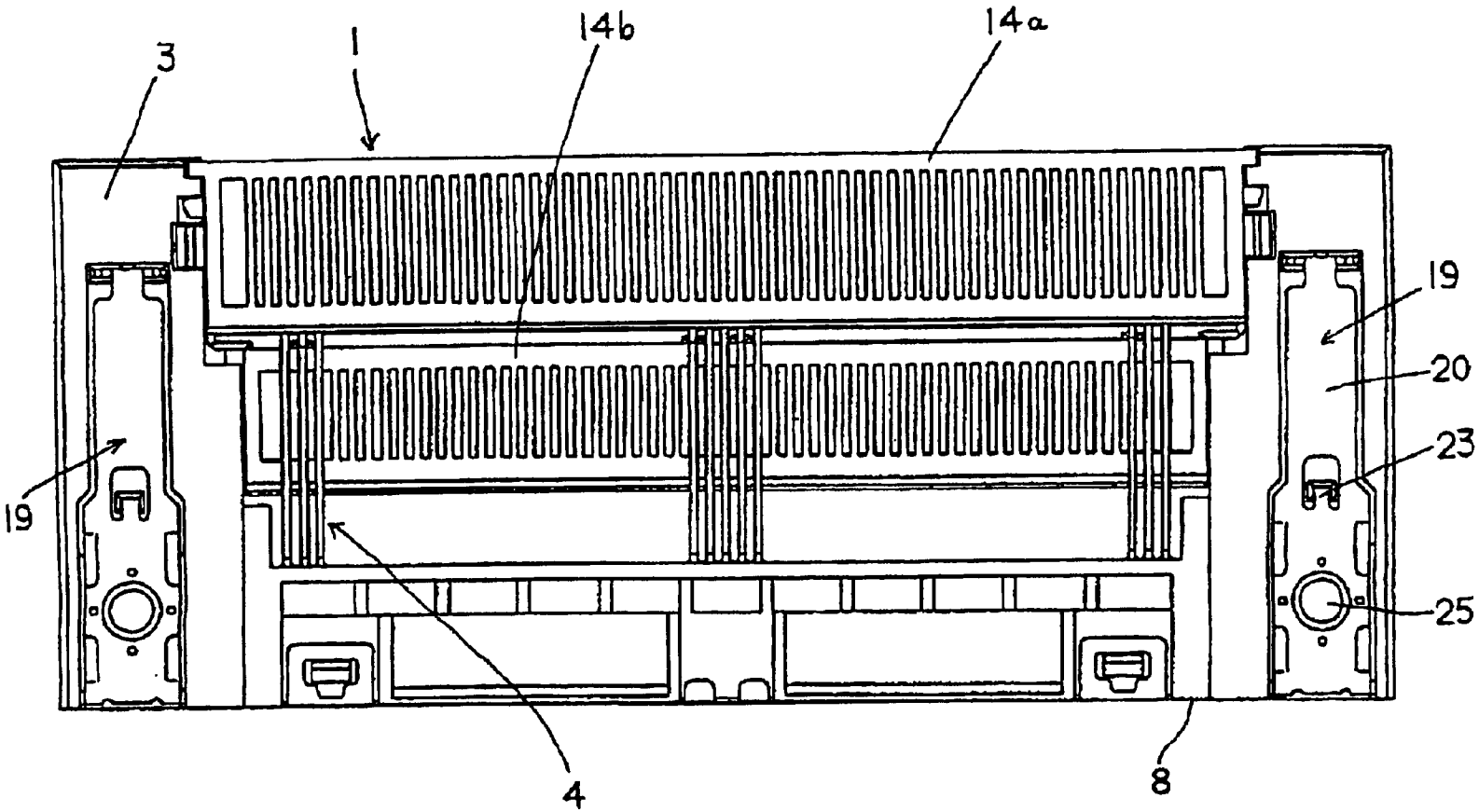
FIG. 4 is a plane view of the connector.
Figure 5:
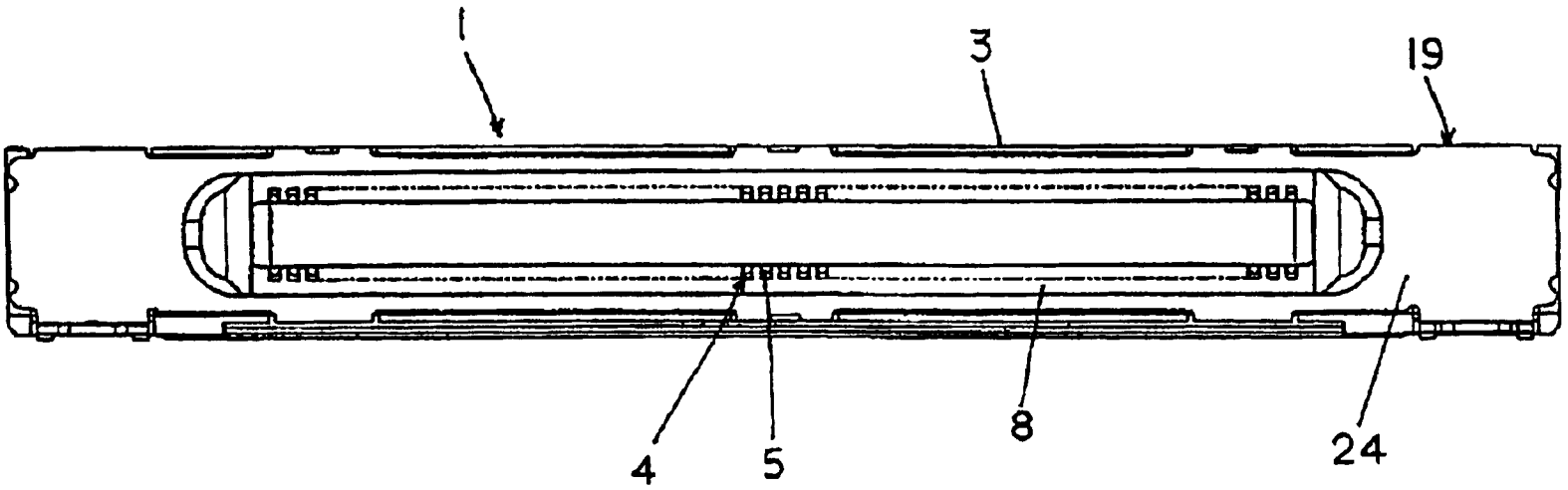
FIG. 5 is a front view of the connector.
Figure 6:
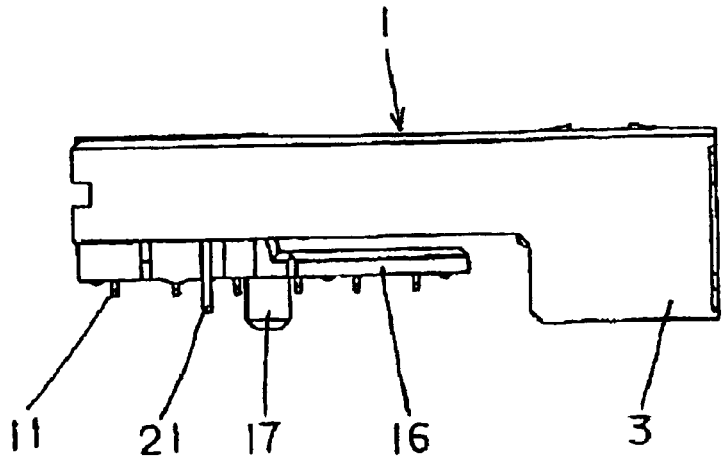
FIG. 6 is a side view of the connector.
Figure 7:
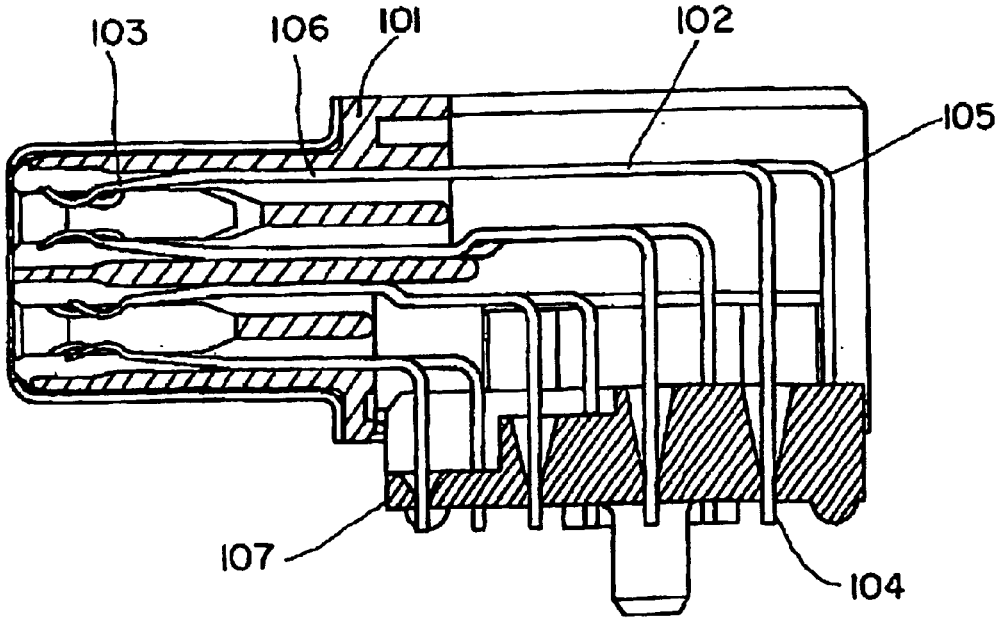
FIG. 7 is cross section of a conventional right-angled type of connector.
Figure 8:
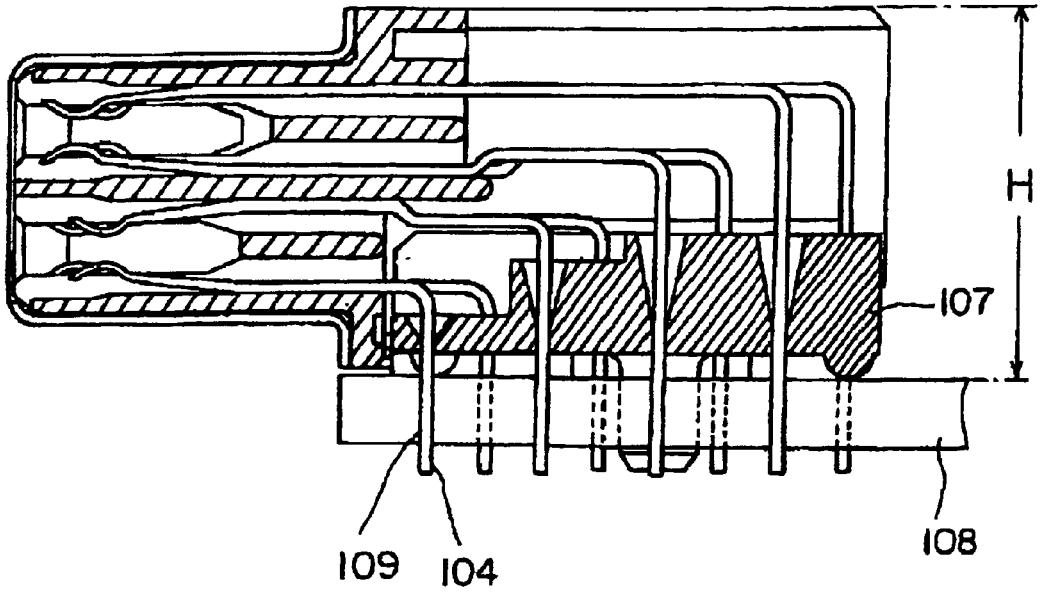
FIG. 8 is similar to FIG. 7, but showing the conventional right-angled type of connector as being mounted on a printed circuit board.

Referring to FIGS. 1, 2 and 4, terminals 4 are parallel-arranged at regular intervals longitudinally in FIG. 4 perpendicular to the sheet of drawing in FIG. 1 or 2).

Each terminal 4 comprises an engagement section 6 integrally connected to the contact section 5 on one end and to the intermediate crank-like section 9 on the other end. The crank-like section 9 ends with the tail 11. Specifically, the crank-like section 9 is composed of a riser 12 integrally connected to the engagement section 6 at right angles, a straight extension 13 integrally connected to the riser 12 at right angles and a descendant extension 10 integrally connected to the straight extension 13 at right angles. The distal tip of the descendant extension functions as a solder tail 11. Thus, the contact section 5 is located below the straight extension 13.

A plurality of terminals 4 are so arranged in upper and lower lines in the insulating housing 3 that the upper straight extension 13 of the crank-like section 9 of each of the terminals 4 arranged in the lower line may be located at a level higher than the level at which the engagement section 6 of each of the terminals 4 arranged in the upper line.

The insulating housing 3 has an upper stop surface 14*a* and a lower stop surface 14*b* traversing a longitudinal length of the insulating housing 3, allowing the straight extensions 13 of the crank-like sections 9 of the upper and lower terminals 4 to abut on their respective overlying stop surfaces. Thus, the stop surfaces prevent the straight extensions 13 of the crank-like sections 9 from rising up when the connector is mounted to its mounting substrate 2.

A movable guide plate 16 has through holes 15 corresponding to the terminals 4 and is movably attached to the insulating housing 3 by inserting the tails 11 of the terminals 4 in the through holes 15. The movable guide plate 16 has a boss 17 formed on its lower surface. The connector can be attached to an associated substrate, in this instance, a printed circuit board 2, by inserting the boss 17 into the positioning hole 18 of the printed circuit board 2.

Figure 3:
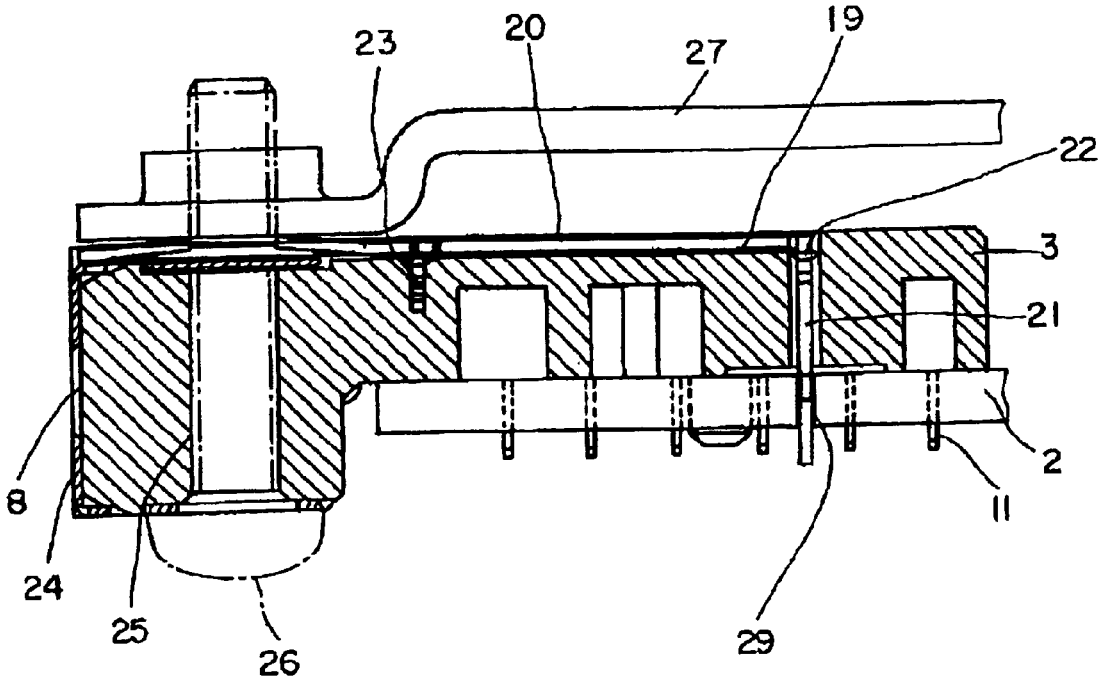
FIG. 3 is a cross section of the connector at an enlarged scale on its rear side.

The insulating housing 3 has two "L"-shaped metal pegs 19 attached to its lateral sides. As seen from FIGS. 3 and 4, each metal peg 19 has its horizontal beam 20 extending from the plug-inserting section 8 close to the front side of the insulating housing 3, and its vertical leg 21 passing through the thickness of the insulating housing 3, extending parallel to the descendent extension 10 of the terminal 4 as far as the end of the tail 11. The horizontal beam 20 has an indented engagement projection 23 formed at its middle, and the engagement projection 23 is fit into the upper surface of the insulating housing 3.

The end of the horizontal beam 20 of the "L"-shaped metal peg 19 is located on the metal shell 24, which is fitted on the plug-inserting section 8 of the insulating hosing 3. As seen from FIGS. 3 and 4, a through hole 25 is mad e at a selected place at which the end of the horizontal beam 20 is located on the metal shell 24, and the electrical connector 1 is fixed to a metal housing 27 by inserting a bolt 26 in the hole 25 and by tightening the bolt with an associated nut.

When the right-angled type of connector 1 is attached to an associated printed circuit board 2, the guide plate 16 is raised to allow the tails 11 of the terminals 4 to project from the lower surface of the guide plate 16. When raising the guide plate 16 the straight extensions 13 of the crank-like sections 9 are raised, so that they are abutted against the overlying upper and lower stop surfaces 14*a*, 14*b*. Thus, the straight extensions 13 of the crank-like sections 9 are prevented from being raised forcedly and deformed.

The straight extensions 13 of the crank-like sections 9 are sandwiched between the overlying stop surfaces 14*a*, 14*b* and the guide plate 16, allowing the tails 11 of the crank-like sections 9 to pass through the through holes 28 of the printed circuit board 2. When inserting the tails 11 in the through holes 28, a raising force is applied to the straight extension 13 of each crank-like section 9 via its tail 11, but the rising of the straight extension 13 can be reduced by the overlying stop surfaces 14*a*, 14*b*.

As seen from FIG. 2, use of crank-like terminals 4 permits the height of the insulating housing 3 to be reduced to possible minimum H'. The height of the insulating housing 3 can be effectively reduced by arranging two lines of such crank-like terminals 4 at upper and lower levels with the straight extension 13 of each terminal 4 in the lower line lying at a level higher than the level at which the engagement section 6 of each terminal 4 in the higher line.

When the tails 11 of the terminals 4 are inserted in the through holes 28 of the printed circuit board 2, the vertical extension 21 of each "L"-shaped metal peg 19 is inserted in a through hole 29 made in the printed circuit board 2 (see FIG. 3), thereby preventing the insulating housing 3 from being inclined relative to the printed circuit board, so that the soldering of the tails 11 may be facilitated. The soldering of the vertical extension 21 of the "L"-shaped metal peg 19 will increase the strength with which the electrical connector 1 can be fixed to the printed circuit board 2.

The end of the horizontal extension 20 of the "L"-shaped metal peg 19 is located on the metal shell 24, and is fixed both to the metal shell 24 and the metal housing 27 by tightening the screw 26. If the electric shell 24 is charged with electricity, the static electricity can flow from the electric shell 24 to the metal housing 27.

Use of crank-like terminals having their contacts formed at low level permits the insulating housing to be reduced in height, and such low-profiled connector when mounted on an associated printed circuit board is as tall as other electric or electronic parts mounted on the printed circuit board.

While a preferred embodiment of the present invention is shown and described, it is envisioned that those skilled in the art may devise various modifications of the present invention without departing from the spirit and scope of the appended claims. The present examples and embodiments, therefore, are to be considered in all respects as illustrative and not restrictive, and the invention is not to be limited to the details given herein.

What is claimed is:

1. A electrical connector, comprising:

an insulating housing, the insulating housing having a stop surface and a moveable guide plate having a plurality of apertures; and a plurality of terminals arranged in the insulating housing, each terminal having a tail portion and a contact portion, the tail portion being at an angle relative to the contact portion, wherein each terminal includes an intermediate portion located between the tail portion and the contact portion, the intermediate portion including a straight portion located in a plane that is located higher than a plane containing the contact portion, wherein the stop surface is located above the terminal intermediate portion, wherein the tail portions of the terminals are received within the apertures, and wherein the movable guide plate is sized and shaped to sandwich the terminal straight portions between the stop surface and the guide plate when the tail portions are inserted in a printed circuit board through hole.

2. The electrical connector of claim 1, wherein the angle between the tail portion and the contact portion is generally a right angle.

3. The electrical connector of claim 1, wherein the intermediate portion is a straight extension portion.

4. The electrical connector of claim 1, wherein the stop surface prevents the terminal intermediate portion from rising up when the tail portions of the terminals are mounted into a printed circuit board through hole.

5. The electrical connector of claim 1, wherein the plurality of terminals are located in an upper row and a lower row.

6. The electrical connector of claim 5, wherein the stop surface is located above the upper row of terminals and wherein the insulating housing includes a stop surface located above the lower row of terminals.

* * * * *